United States Patent [19]

Shepherd

[11] Patent Number: 4,787,514

[45] Date of Patent: Nov. 29, 1988

[54] PROCESS AND APPARATUS FOR HANDLING PRESSURIZED SPRAY PAINT CONTAINERS

[76] Inventor: Willard W. Shepherd, P.O. Box 22122, Los Angeles, Calif. 90022

[21] Appl. No.: 66,454

[22] Filed: Jun. 26, 1987

[51] Int. Cl.[4] ..... B65D 65/00

[52] U.S. Cl. ..... 206/427; 211/71; 211/74; 222/173; 220/21; 220/22

[58] Field of Search ..... 220/21, 22, 23.2, 23.6, 220/23.8, 23.83; 229/120.07, 120.32, 120.35; 206/427, 503, 526; 211/74, 71; 222/635, 173

[56] References Cited

U.S. PATENT DOCUMENTS

| | | | |
|---|---|---|---|
| 2,321,836 | 6/1943 | Marzo | 222/173 |
| 2,443,871 | 6/1948 | Shield | 211/71 |
| 2,755,923 | 7/1956 | Guilleminot et al. | 206/427 |
| 2,802,649 | 8/1957 | Stockton | 211/71 |
| 3,160,278 | 12/1964 | Varkala | 211/74 |
| 3,199,708 | 8/1965 | Shlesinger, Jr. et al. | 220/21 |
| 3,371,840 | 3/1968 | Schlager et al. | 229/120.07 |
| 3,606,023 | 9/1971 | Edmunds | 211/74 |
| 3,612,336 | 10/1969 | Wilkich | 220/21 |
| 4,036,391 | 7/1977 | Prodel | 220/21 |
| 4,182,455 | 1/1980 | Zurawin | 211/71 |
| 4,270,662 | 6/1981 | Gonzalez | 211/74 |
| 4,567,989 | 2/1986 | Hurst, Jr. | 211/74 |

FOREIGN PATENT DOCUMENTS

| | | | |
|---|---|---|---|
| 3324977 | 1/1985 | Fed. Rep. of Germany | 222/173 |

*Primary Examiner*—David T. Fidei

*Attorney, Agent, or Firm*—Harris, Kern, Wallen & Tinsley

[57] ABSTRACT

Process and apparatus for handling pressurized spray paint containers having a spray control nozzle at the top with an internal transport tube attached to the nozzle and extending to the bottom of the container, with the containers being maintained in a controlled position in a rack with the container axis generally horizontal whereby the paint solids in the container are away from the inner end of the tube.

7 Claims, 2 Drawing Sheets

FIG. 1.
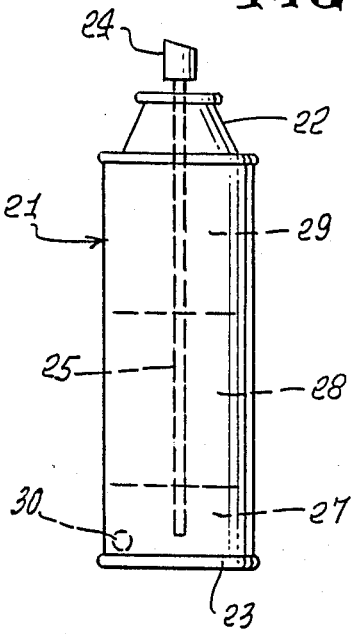
FIG. 2.
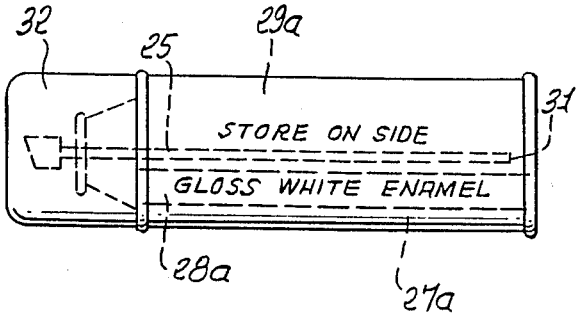
FIG. 2a.
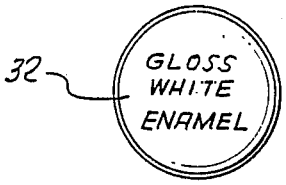
FIG. 3.
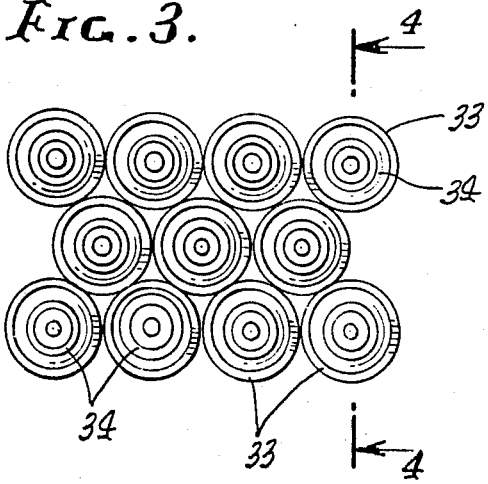
FIG. 4.
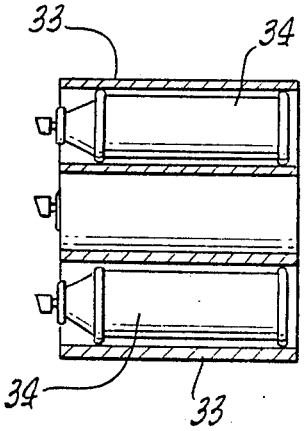
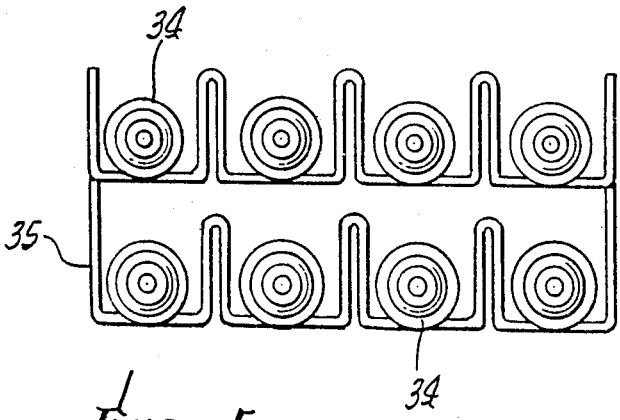
FIG. 5.
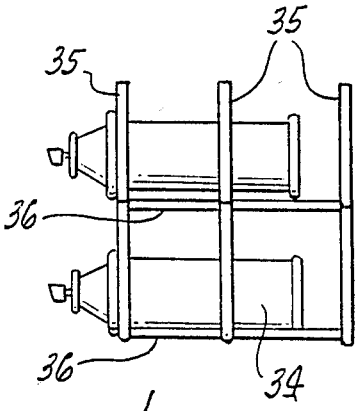
FIG. 6.

PROCESS AND APPARATUS FOR HANDLING PRESSURIZED SPRAY PAINT CONTAINERS

BACKGROUND OF THE INVENTION

This invention relates to pressurized spray paint containers, and in particular to a new and improved process and apparatus for handling such containers.

A typical pressurized spray paint container is shown in FIG. 1 and comprises a cylindrical can 21 with a top 22 and a bottom 23. A spray control nozzle 24 is mounted in the top 22, and a transport tube 25 is positioned within the container. The outlet end of the transport tube is connected to the control nozzle and the inlet end of the tube terminates adjacent the bottom 23. The container is charged with a mixture of paint solids 27, paint solvent 28, and a propellant 29.

In use, the container is shaken to mix the paint solids and paint solvent and then the spray control nozzle is manually depressed, with the container in a generally upright position. Depressing the nozzle opens a flow path from the interior of the container up through the transport tube and out the spray nozzle, with the propellant forcing the paint solvent/solid mixture out the nozzle.

During storage, the paint solids settle at the bottom of the container, as shown in FIG. 1. Sometimes a metal ball 30 is included within the container to aid in mixing the paint solids and solvent when the container is shaken.

Pressurized spray paint containers of the type described above have been generally available and widely used for many years. However there is a problem with this product, which problem has been in existence since the pressurized spray paint container was first available, and which problem has not been satisfactorily resolved. When a container is stored for any period of time, the paint solids settle to the bottom, as shown in FIG. 1, and some of the solids enter the inlet end of the transport tube, particularly after the container has been used for some painting operation. Once the paint solids harden in the transport tube, the container is no longer usable since it is nearly impossible to clean the hardened solids from the transport tube by agitation. This necessitates discarding the container with its still usable charge of propellant and paint.

SUMMARY OF THE INVENTION

It is an object of the present invention to provide a new and improved process and apparatus for handling pressurized spray paint containers in order to overcome the problem of the plugged transport tube within the container and the resultant waste of otherwise usable pressurized spray paint containers.

In the present invention, the conventional containers are stored, shipped and displayed in a controlled position with the container axis at an angle to the vertical so that the paint solids are away from the inlet end of the transport tube. Typically the container is maintained with its axis generally horizontal, but other orientations are also usable for achieving the object of the invention.

The apparatus of the invention comprises the combination of a rack with a plurality of support units, and pressurized spray paint containers mounted in the support units, with the rack structured such that the individual containers are supported with each container axis at an angle to the vertical, typically horizontal. Various configurations for the rack are disclosed, and others will be readily apparent once the combination of the invention is understood.

Other objects, advantages, features and results will more fully appear in the course of the following description.

BRIEF DESCRIPTION OF THE DRAWINGS

FIG. 1 is a side view of a pressurized spray paint container with the container axis vertical;

FIG. 2 is a view similar to that of FIG. 1 with the container axis horizontal and with a cover on the container;

FIG. 2*a* is a top end view of the container of FIG. 2;

FIG. 3 is an end view of a rack with tubular support units and containers positioned therein, and incorporating the presently preferred embodiment of the invention;

FIG. 4 is a sectional view taken along the line 4—4 of FIG. 3;

FIG. 5 is a view similar tothat of FIG. 3 showing a rack in the form of a wire frame;

FIG. 6 is a side view of the apparatus of FIG. 5;

DESCRIPTION OF THE PREFERRED EMBODIMENTS

Figure 7:
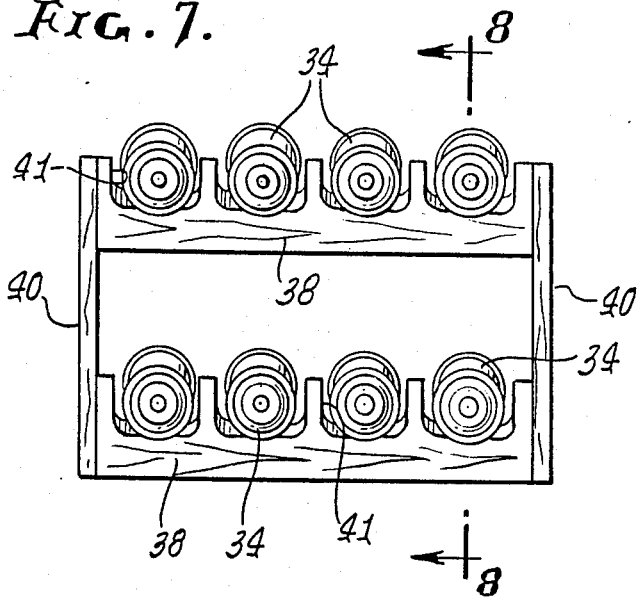
FIG. 7 is a view similar to that of FIGS. 3 and 5, with the rack formed of a plurality of plates.

In the process of the present invention, the pressurized spray paint container is maintained in a controlled position with the container axis at an angle to the vertical, whereby the paint solids in the container are away from the inlet end of the tube. This arrangement is illustrated in FIG. 2, with the axis of the cylindrical container horizontal. When the container is stored in this configuration, the paint solids settle along a side wall of the container, as shown at 27*a*. The paint solvent is in a strata above the solids, as indicated at 28*a*, and the propellant is in the upper portion as indicated at 29*a*. With this arrangement, the inlet end 31 of the transport tube 25 is well clear of the paint solids 27*a*.

In FIG. 2, the container is shown with a conventional plastic or metal cover 32 in place over the top 22 and nozzle 24. The legend "STORE ON SIDE" preferably is applied on the side of the container so that it is most easily read when the container is horizontal. The color designation, such as "GLOSS WHITE ENAMEL", preferably is applied in the same manner on the container and on the cover.

The presently preferred configuration for the apparatus is illustrated in FIGS. 3 and 4. A plurality of tubes 33 are joined together in side by side arrangement, typically by cementing or soldering. The tubes may be paper or plastic or metal, as desired. The tubes as illustrated are open at both ends, but may be closed at one end if desired. A cover for the complete assembly of tubes can be used for shipping and/or long term storage if desired.

A pressurized paint spray container 34 is positioned in a tube 33 so that the container is maintained with the container aixs horizontal. Also, the top of the container with the spray control nozzle is visible through an open end of the tube and readily permits removal and insertion of a container in a tube. With this arrangement, the container is maintained in the horizontal position at all times except when in use, and the combination is ideally suited for display at retail stores and for storage at work places.

An alternative arrangement for the rack is shown in FIGS. 5 and 6. The rack is formed of three frames 35, each formed of a wire bent in the configuration seen in FIG. 5. The frames 35 are joined by horizontal grids 36 which when the frames and grids are joined together form a rigid rack with support units for individual containers 34.

Figure 8:
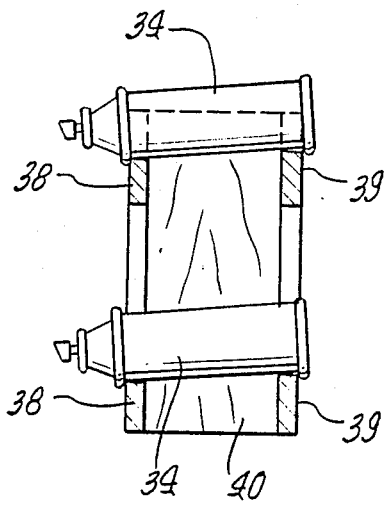
FIG. 8 is a sectional view taken along the line 8—8 of FIG. 7.

Another embodiment is shown in FIG. 7 and 8. Front plates 38 and corresponding rear plates 39 are joined by side plates 40 to form the rack. Typically the plates are formed of wood or plastic or sheet metal, with the front and rear plates having corresponding notches 41 which define the support units for the containers 34. In this embodiment, the front and rear plates are designed so that the notches of the rear plates are higher than the notches of the front plates with the tops of the containers being lower than the bottoms of the containers when positioned in the support units.

Figure 9:
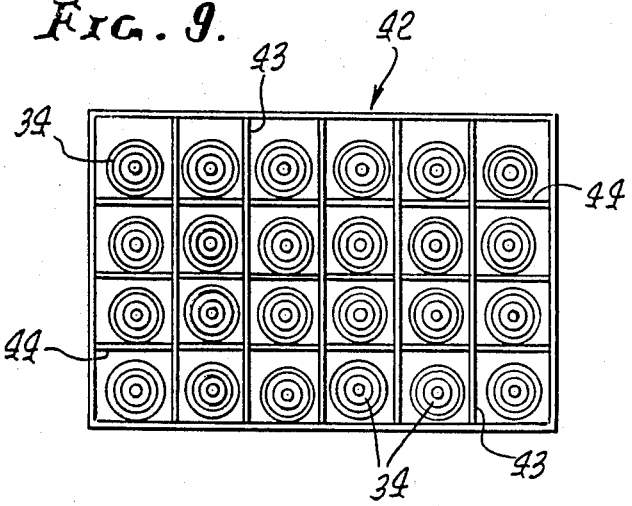
FIG. 9 is a view similar to that of FIGS. 3, 5 and 7 with the rack comprising a storage carton.
Figure 10:
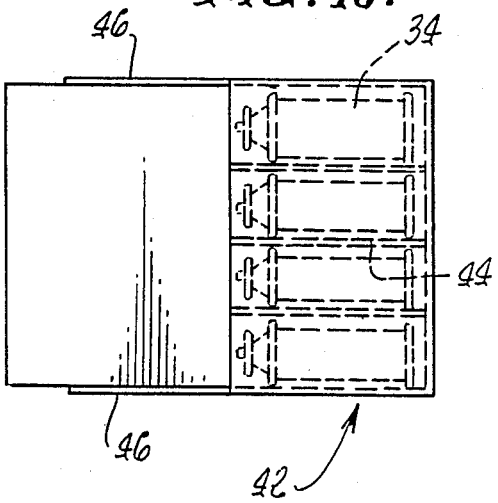
FIG. 10 is a side view of the apparatus of FIG. 9 with the carton in the open condition.
Figure 11:
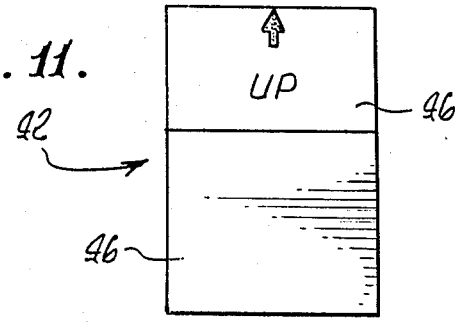
FIG. 11 is a view similar to that of FIG. 10 with the carton in the closed condition.

Another alternative embodiment is shown in FIGS. 9–11, where the rack may be in the form of a typical bottle carton including a box 42 having intersecting dividers 43, 44 which define the support units. As seen in the side view of FIG. 10, this carton is positioned on what is normally considered the side of a carton. In the open condition as shown in FIG. 10, the flaps 46 are open providing access to the support units for removing and inserting the containers. In FIG. 11, the front of the carton is shown with the flaps closed, with the legend UP and arrow indicating the orientation to be maintained for the carton. This legend could be placed on all four sides, and the legends TOP and BOTTOM placed on the top and bottom, respectively, so that the orientation of the containers is maintained at all times.

Thus it is seen that the object of the invention is achieved in the apparatus with the combination of the rack providing support units for containers with the container axis at an angle to the vertical, and with a plurality of containers positioned in the support units.

I claim:

1. In an apparatus for handling pressurized spray paint containers, the combination of:

a rack having a plurality of support units; and a plurality of pressurized spray paint containers having a generally cylindrical configuration about a container axis with a top and a bottom, a spray control nozzle at said top end of said container, and a transport tube positioned within said container and having inlet and outlet ends, with said outlet end connected to said control nozzle, and with said container charged with a mixture of paint solvent, paint solids, and propellant, which paint solids settle in said paint solvent toward the lowestmost portion of said container under the influence of gravity;

with individual containers supported in individual support units with said container axis at an angle to the vertical whereby said paint solids in said container settle away from said inlet end of said tube.

2. An apparatus as defined in claim 1, wherein said rack includes a plurality of tubes mounted side by side to form said support units.

3. An apparatus as defined in claim 1 wherein said rack comprises a wire frame with a bottom grid and vertical dividers forming said support units.

4. An apparatus as defined in claim 1 wherein said rack comprises a front plate with a plurality of notches, a rear plate with a corresponding plurality of notches, and side plates joining said front and rear plates with corresponding notches in alignment forming said support units.

5. An apparatus as defined in claim 1 wherein said rack comprises a storage carton comprising a box having a plurality of transversely positioned intersecting dividers defining said support units, with said box having a top surface and a bottom surface with said container axes parallel to said top and bottom surfaces.

6. An apparatus as defined in any of claims 1–5 wherein said support units support said containers with said container axes generally horizontal.

7. An apparatus as defined in any of claims 1–5 wherein said support units support said containers with said top ends of said container axes no higher than said bottom ends.

* * * * *